United States Patent [19]

Giuffre

[11] 4,050,446

[45] Sept. 27, 1977

[54] ENVIRONMENTAL HOOD AND DUCT STRUCTURE FOR GRIDDLES

[76] Inventor: Anthony A. Giuffre, 4344 N. 70th St., Milwaukee, Wis. 53216

[21] Appl. No.: 711,623

[22] Filed: Aug. 4, 1976

[51] Int. Cl.[2] ..... F24C 15/20

[52] U.S. Cl. ..... 126/299 E; 55/DIG. 36

[58] Field of Search ..... 98/115 K; 126/299 R, 126/299 A, 299 B, 299 E; 55/DIG. 36

[56] References Cited

U.S. PATENT DOCUMENTS

| | | | |
|---|---|---|---|
| 3,263,595 | 8/1966 | Bower | 126/299 R |
| 3,410,195 | 11/1968 | King | 98/115 K |
| 3,433,146 | 3/1969 | Russell | 98/115 K |
| 3,566,585 | 3/1971 | Voloshen et al. | 98/115 K |
| 3,616,744 | 11/1971 | Jensen | 98/115 K |
| 3,667,371 | 6/1972 | Russell | 98/115 K |

*Primary Examiner*—Ronald C. Capossela
*Attorney, Agent, or Firm*—McWilliams & Mann

[57] ABSTRACT

An environmental hood and duct structure for griddle and the like cooking equipment used in restaurant and similar facilities, for degreasing the air ambient to the cooking equipment, including a hood arrangement defining a water spray chamber having an air intake opening overlying the cooking surface of the cooking equipment involved, in which air intake opening is mounted an upwardly inclined grilling formed to define a plurality of individual grille openings shaped to provide a venturi effect on the air passing therethrough. The air is drawn across the cooking surface and into and through the grilling at a rate on the order of 1,000–3,000 cubic feet per minute, with the venturi affected air, on passing into the spraying chamber, being subjected to a cool water spray for wet scrubbing of the grease from the air. The scrubbed air is discharged to the atmosphere. The hood and duct structure includes a collection trough at the base of the grille for collecting the sprayed water and resulting solidified grease, and a make-up air duct opening adjacent the locale of the air inflow side of the hood grilling. The arrangement includes equipment for separating the grease from the water, and for recycling the water through the system.

10 Claims, 8 Drawing Figures

ENVIRONMENTAL HOOD AND DUCT STRUCTURE FOR GRIDDLES

This invention relates to an environmental hood and duct structure for griddles and the like cooking equipment of the type used in the restaurant and the like facilities, and more particularly, to a hood and duct structure for equipment of the type indicated for degreasing the air ambient to the cooking area as well as ventilating the cooking area, and a method of wet scrubbing air drawn off over the working surface of griddles and the like.

Griddles and the like cooking equipment in restaurant facilities, particularly in the short order field, are frequently in intensive use for long periods of time, with the volume and nature of the food cookery involved presenting air fouling problems that require air cleaning on a high volume scale to avoid fouling of the ambient air within the facility and/or discharging polluted ar to the atmosphere.

This type of cooking equipment by its nature also has an ever-present fire hazard problem requiring provision for adequate and safe fire containment should the grease covered cooking surfaces become ignited.

A principal object of the present invention is to provide an environmental hood and duct arrangement for griddles and the like cooking equipment that is especially suited for air purification and fire containment purposes in restaurant facilities.

Another principal object of the invention is to provide an environmental hood and duct structure for griddles and other cooking equipment arranged for wet scrubbing of the air ambient to the cooking surface of such equipment.

Other objects of the invention are to provide an air purification system and method for use in connection with frying and other open cooking type cooking equipment, to provide a self-contained air purification arrangement for food cooking installations involving a water spray degreasing facility and closed circuit circulation system therefor providing for separating out of the solidified grease and recycling of the water through the system, and to provide an environmental hood and duct structure for griddles and the like that is economical of manufacture, convenient to install and efficient in operation.

In accordance with the invention, an environmental hood and duct structure for griddles and the like, and other similar types of open cooking equipment, for degreasing the air ambient to the cooking surfaces involved, is provided including a hood arrangement defining a water spray chamber having an air intake opening overlying the cooking equipment, in which is mounted an upwardly inclined grilleing formed to define a plurality of individual grille openings shaped to provide a venturi effect on the air passing therethrough. The spray chamber is connected to blower equipment for drawing air through the grilleing at a rate on the order of 1,000–3000 cubic feet per minute, with the venturi affected air in passing into the spraying chamber being subjected to a cool water mist type spray for wet scrubbing the grease from the air. The scrubbed air under the action of the blower is discharged to the atmosphere. The hood and duct structure includes a collection through at the base or foot of the grille for collecting the sprayed water and resulting solidified grease, which trough is incorporated in a self-contained water circulation system that provides for separation of the solidified grease from the water and recirculating of the water through the spray nozzles.

The hood and duct structure includes ducting for supplying make-up air adjacent the locale of the air inflow side of the hood grilling.

Further in accordance with the invention, the air ambient to the griddle cooking surface is drawn across the top of same at a rate on the order of 1,000–3,000 cubic feet per minute and subjected to a wet scrubbing venturi affect having a venturi ratio in the range of from about 3 to 1 to about 4 to 1, whereby the temperature of the air is reduced to induce solidification of grease in gaseous or liquid form. The venturi affected air is subjected to a cool water mist like spray to wet scrub the grease from the air, with the water and the grease being collected for separation of the grease from the water and recycling of the water through the system.

Other objects, uses, and advantages will be obvious or become apparent from a consideration of the following detailed description and the application drawings in which like parts are indicated by like reference numerals throughout the several views.

However, it is to be distinctly understood that the specific drawing illustrations provided are supplied primarily to comply with the requirements of the Patent Laws, and that the invention is susceptible of modifications and variations that will be obvious to those skilled in the art who have the disclosure before them will be able to make modifications and variations therein without departing from the scope of the invention.

GENERAL DESCRIPTION

Figure 2:
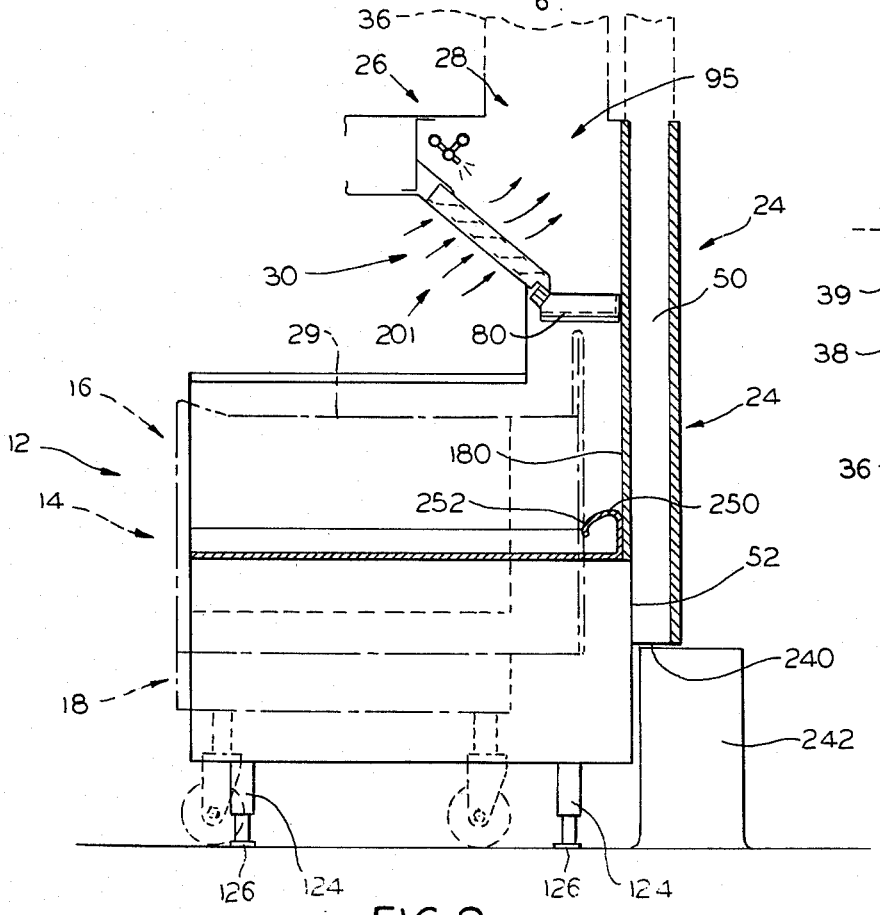
FIG. 2 is a diagrammatic cross-sectional view taken substantially along line 2—2 of FIGS. 1 and 7, showing the internal arrangement of the spray chamber of the hood and duct structure, and illustrating the griddle in phantom as applied to the hood and duct structure.
Figure 7:
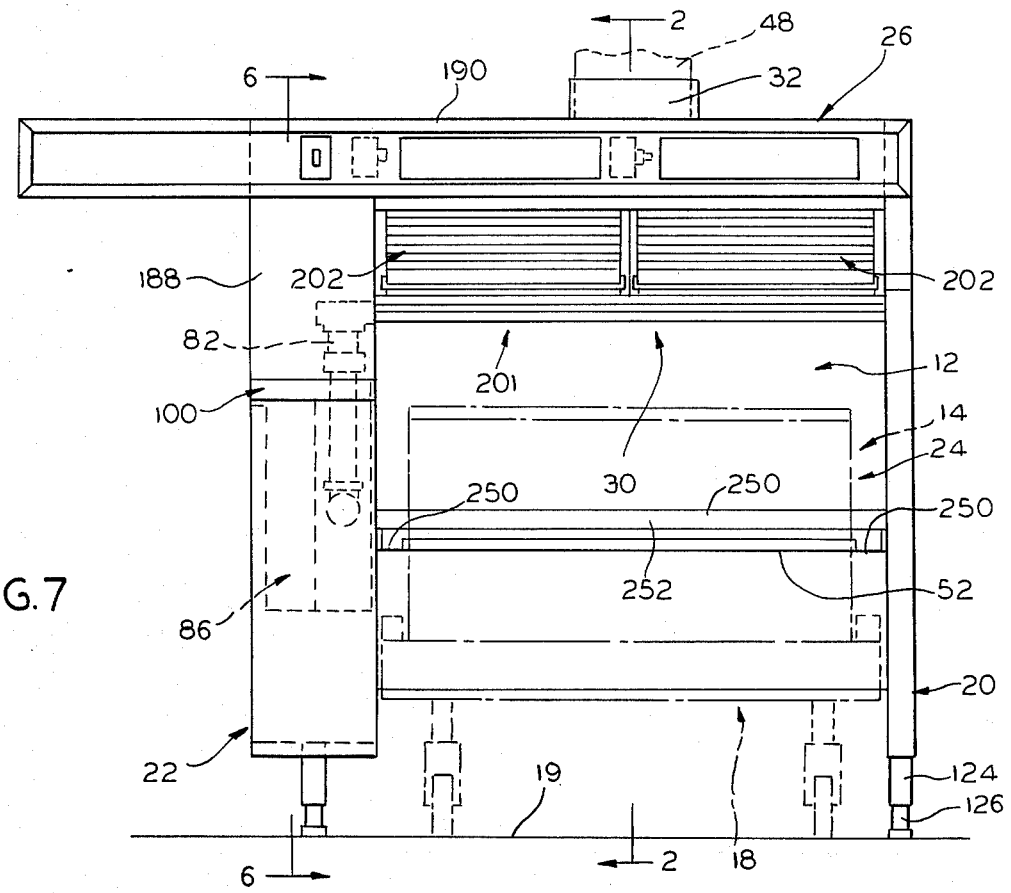
FIG. 7 is a front elevational view of the hood and duct structure, showing in phantom the griddle positioned in operative relation thereto, as is also indicated by FIG. 2.

Reference numeral 10 generally indicates a hood and duct structure or assembly, arranged in accordance with the present invention, with the form illustrated being generally U-shaped in horizontal section to define a central mounting space 12 that is to receive a griddle unit 14 of a commercially available type which is shown in phantom in FIGS. 2 and 7, and comprises a griddle of the electrically operated type indicated at 16 mounted on a wheeled griddle support 18. Unit 14 as shown is illustrative of ranges made by Wolf Range Co.

However, the showing of the griddle as indicated is for illustrative purposes only as the invention is adapted for application to any conventional type of open cooking (frying or grilling equipment). The structure 10 and support 18 are shown resting on floor surface 19 of the restaurant facility involved.

The hood structure 10 in the form shown comprises a right hand wall structure 20, a left hand wall structure 22, a cross wall structure 24 that extends between and joins the side wall structures 20 and 22, and a header structure 26 which extends across and forwardly of the cross wall structure 24.

Figure 3:
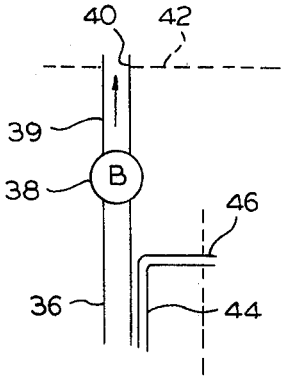
FIG. 3 is a diagram illustrating schematically the air discharge and make-up ducting to which the hood and duct structure of the illustrated embodiment may be connected.
Figure 4:
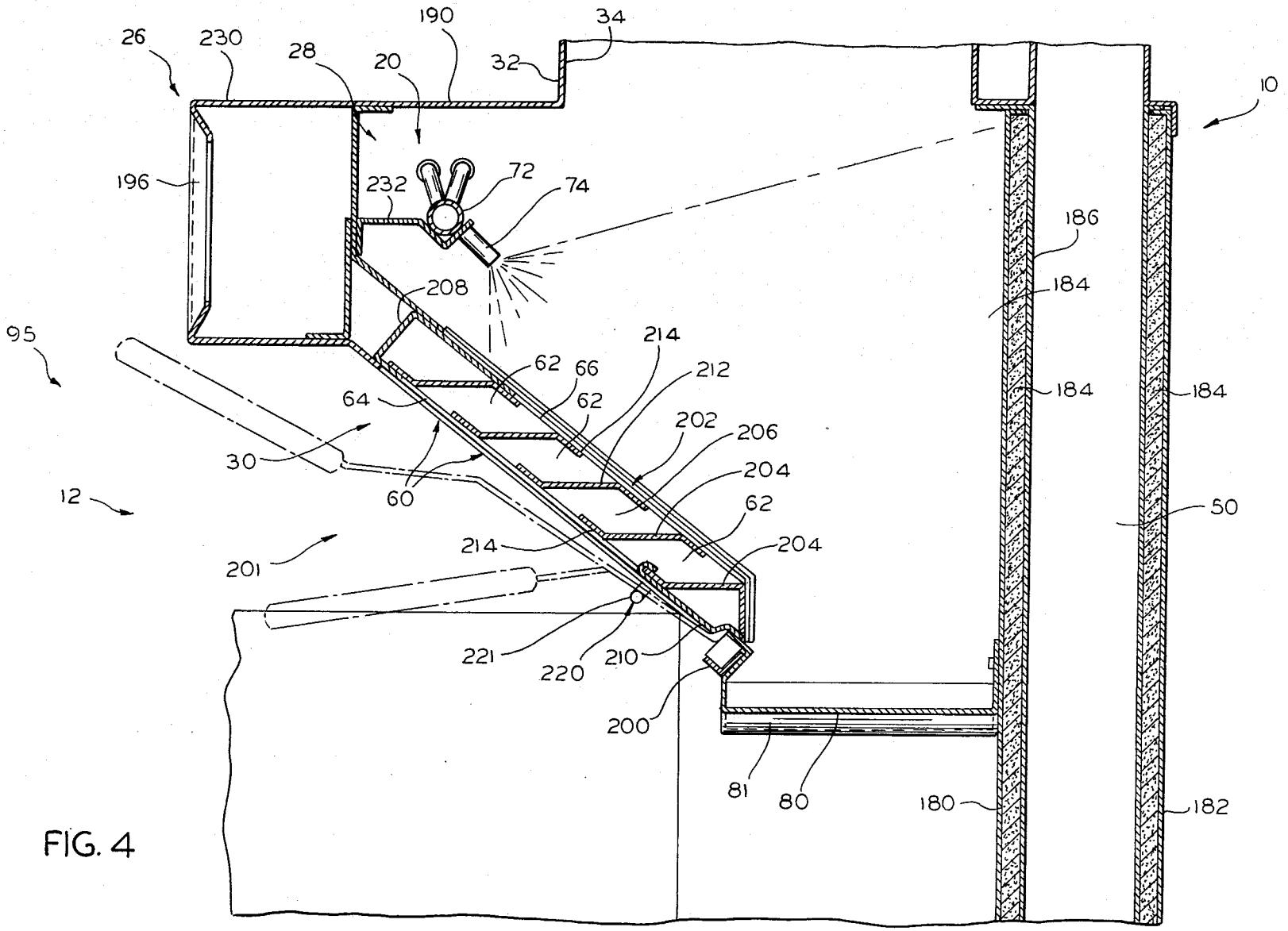
FIG. 4 is a fragmental sectional view taken along line 2—2 of FIGS. 1 and 7, on an enlarged scale and illustrating specifically the hood and duct structure grille and and spray chamber arrangement.

As indicated in FIGS. 2 and 4, the cross wall structure 24 and the header structure 26 are formed to define a spray chamber 28 (FIGS. 2 and 4) that is disposed above the level of griddle working surface 29, and that has its underside defined in part by an upwardly and forwardly inclined air baffle or grille structure 30 through which ambient air is to be drawn into the spray chamber 28 and out of the spray chamber 28 through the hood and duct structure outlet 32 that defines outlet opening 34. As indicated at FIGS. 2 and 3, the outlet 32 is suitably connected to main duct 36 that is diagrammatically illustrated in FIG. 3 as communicating with suitable blower 38 which directs the air impelled by the blower to conduit 39 that leads to discharge opening 40 which may be formed in the roof or side wall of the building in which the cooking facility is located, with the building being generally indicated by reference numeral 42.

Make-up air enters make-up duct 44 at inlet 46 that may be formed in the side wall of the building 42, with the duct 44 being suitably connected to inlet 48 of the hood or duct structure 10 (defining make-up inlet port 49), which is formed to define make-up air duct passage 50 that in the form shown has an outlet opening 52 opening forwardly of the cross wall structure 24 in the general locale of the air baffle or grille structure 30, and in the illustrated embodiment, below the level of the grille working surface 29 (see FIG. 2).

The air baffle or grille structure 30 is of special significance, in accordance with the present invention, and is formed to define a plurality of grille openings 60 that are each shaped to define a venturi fluid flow way 62 between the air inlet port 64 and the air outlet port 66 of each opening 60. In accordance with the invention, the air flow ways 62 have a venturi ratio in the range of from about 3 to 1 to about 4 to 1 (ration of inlet port size to outlet port size), whereby the air flow discharging from ways 62 is subjected to a cooling effect (due to expansion) that induces solidification or at least liquification of any vaporized grease in the air flow involved.

As is more specifically illustrated by FIGS. 2 and 4, the air baffle or grille structure 30 is inclined upwardly and forwardly of the cross wall structure 24, and in accordance with the invention, the air baffle or grille structure 30 is inclined with respect to the horizontal at an angle in the range of from about 30° to about 60°, with an angulation of approximately 40° being preferred.

The venturi effect on the air flow through air baffle or grille structure 30, and specifically its ways 62, thus effects a wet scrubbing action on the air passing therethrough.

The spray chamber 28 has a spray nozzle assembly 70 mounted in the same comprising a supply pipe 72 equipped with a plurality of nozzles 74, with the supply 72 extending longitudinally of the header structure 26, and with the nozzles 74 being uniformly spaced therealong for dispersal of water therefrom in the downwardly inclined direction indicated by FIGS. 2 and 4 along the length of the spray chamber 28.

The nozzles 26 are of the familiar commercially available type that produces a fine mist like spray of water in a generally conical pattern, with the spray being indicated in broken lines in FIG. 4. The spray is thus directed downwardly and rearwardly of the spray chamber 28, with the nozzles being aimed in general parallelism to the plane of the baffle or grille structure 30 (see FIG. 4).

The hood and duct structure 10 further includes a trough 80 suitably mounted therein at the base of the air baffle or grille structure 30 into which the water being sprayed collects. The trough 80 extends longitudinally of the spray chamber 28 and is suitably connected to drain pipe 82 which leads to the grease separation tank 86 that is built into the side wall structure 22, from which water drains into drain pipe 88 leading to pump 90 that returns the now essentially grease free water back to the spray nozzle arrangement 70 through suitable conduiting 92, filter 94, and conduiting 96 that is suitably connected to supply pipe 72. Trough 80 has its bottom 81 suitably inclined for good gravity liquid flow characteristics, to and into drain pipe 82.

In accordance with the invention, when the griddle unit 14 is in operation, the blower 38 is operated to draw through the grille structure 30 air that is ambient to the griddle working surface 29 at a rate in the range of from approximately 1,000 cubic feet per minute to approximately 3,000 cubic feet per minute, depending on the intensity of use of the griddle unit 14 and the amount of air needed to be removed from the locale of griddle 14 to maintain adequate ventilation and temperature control comfort conditions. For high intensity use situations and assuming it is desired to maintain the temperature of the air ambient to the cooking facility involved at approximately room temperature (70° F.), the volume rate of flow should be on the higher side, say approximately 2,500 cubic feet per minute; for installations in temperature climates fluid flow requirements will be subject to seasonal variations, of course.

It is also preferred that the temperature of the water being sprayed be in the range of from approximately 50° F. to approximately 60° F. to accentuate the cooling action on the air entering the spray chamber, and thus the wet scrubbing of the grease from the air, prior to its leaving the spray chamber 28. While in many installations spray water temperatues in this range will be available, in more severe situations, the invention is fully operative where the spray water temperature is in the range of 15° to 20° F. below room temperature.

It may also be desirable, thought not essential, to use a suitable chemical wet scrubber in the water of the spray system, such as one of the sodium nitrate base compositions which inhibits the grease from emulsifying, and thus acts as a demulsifier.

When the hood and duct structure are installed and operated in accordance with the invention, the blower 38 and the water circulation system that includes the spray assembly 70 operate continuously while the griddle unit 14 is in use. The grease ladened air ambient to the griddle working surface 29 is drawn through the venturi way 62 of the baffle or grille structure 30 whereby an air passing through the grille structure is subject to the aforementioned venturi effect that achieves a dropping of the temperature of the air which is conductive to returning to liquid or solid form of any volitized grease contained in the air.

As air is drawn through the water spray, the grease still in liquid form solidifies and the solidified grease becomes entrapped by the water and is wet scrubbed from the air and collects with the water in trough 80. The cleaned air leaves the hood and duct structure 10 through outlet 32 and conduit 36 wherein the blower 38 directs the cleaned air outwardly of the building 42 through outlet 40.

The drawing off of the air from above the griddle working surface 29 induces make-up air flow through make-up air conduits 44 and 50 for supply of make-up air to the locale of the grille structure 30, which preferably comes from a fresh air source, such as that indicated in FIG. 3.

During operation of the basic air purification system 95 that is involved, the water and solidified grease (which floats on the water) drain under gravity from trough 80 through conduit 82 to separation tank 86 wherein the grease accumulates on the top of the water in the tank 86 for removal through the removalbe cover 100 of the side wall structure 22. Continuously operating pump 90 draws the grease freed water from the tank 86 and returns it to the nozzles 74 through the conduits 92 and 96.

It will be seen that the invention provides an air purification arrangement and system for use in connection with griddles and the like whereby the air ambient to the griddle working surface is drawn off and subjected to a two way wet scrubbing action, by way of the venturi effect pon the air as it passes through the grille structures 30, and the water scrubbing action of the nozzle spray on the air as it passes through the nozzle spray.

The result is that the grease involved is congealed and washes into trough 80 from which it drains with the spray water to separation tank 86 where the operator can from time to time draw or dip off the accumulated grease on the surface of the liquid in the tank 86.

The spray water is made part of a self contained spraying system whereby sewer discharge of the grease ladened water is avoided, and the water is grease freed and recycled through the system as it operates.

SPECIFIC DESCRIPTION

The framing of the hood and duct structure 10 is diagrammatically illustrated only, since the specific framing structures employed may be varied as needed to suit specific conditions.

In the form shown, the wall structure 20 comprises a side frame 120 suitably secured to the cross wall structure 24 and having suitably secured to same griddle masking panel 22. The frame 120 includes a pair of suitable legs 124 having adjustable feed 126 which may be of the type that are threadedly connected to the legs 124 for varying the vertical positioning of the assembly 10.

Figure 1:
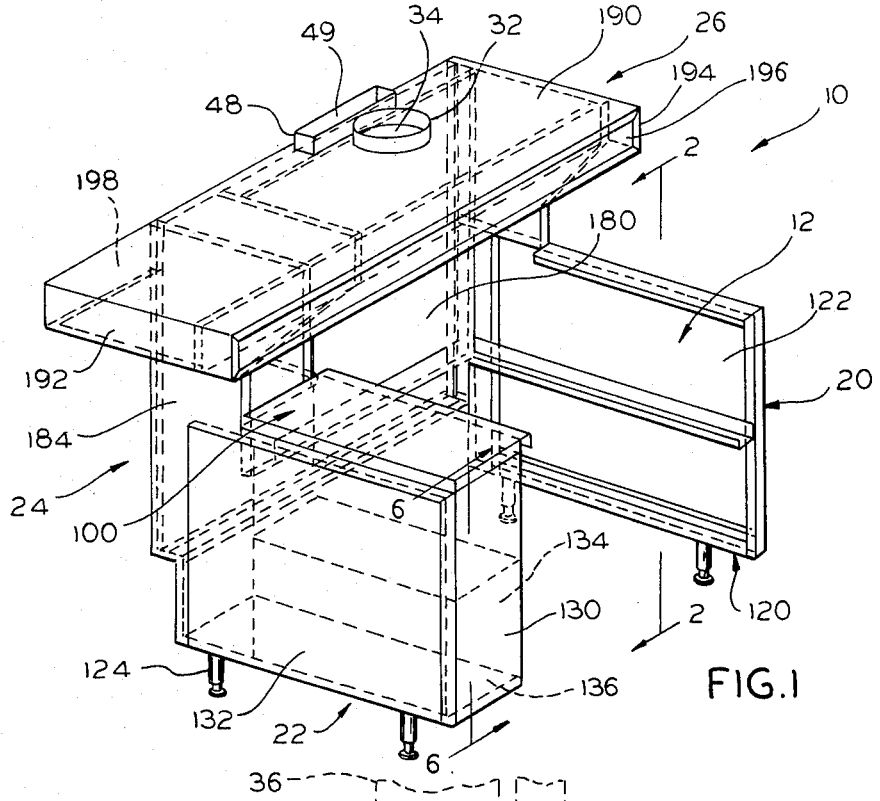
FIG. 1 is a diagrammatic perspective view, largely in block diagram form, illustrating one embodiment of the invention, showing the hood and duct structure as arranged to receive a portable griddle of a common commercially available type.
Figure 6:
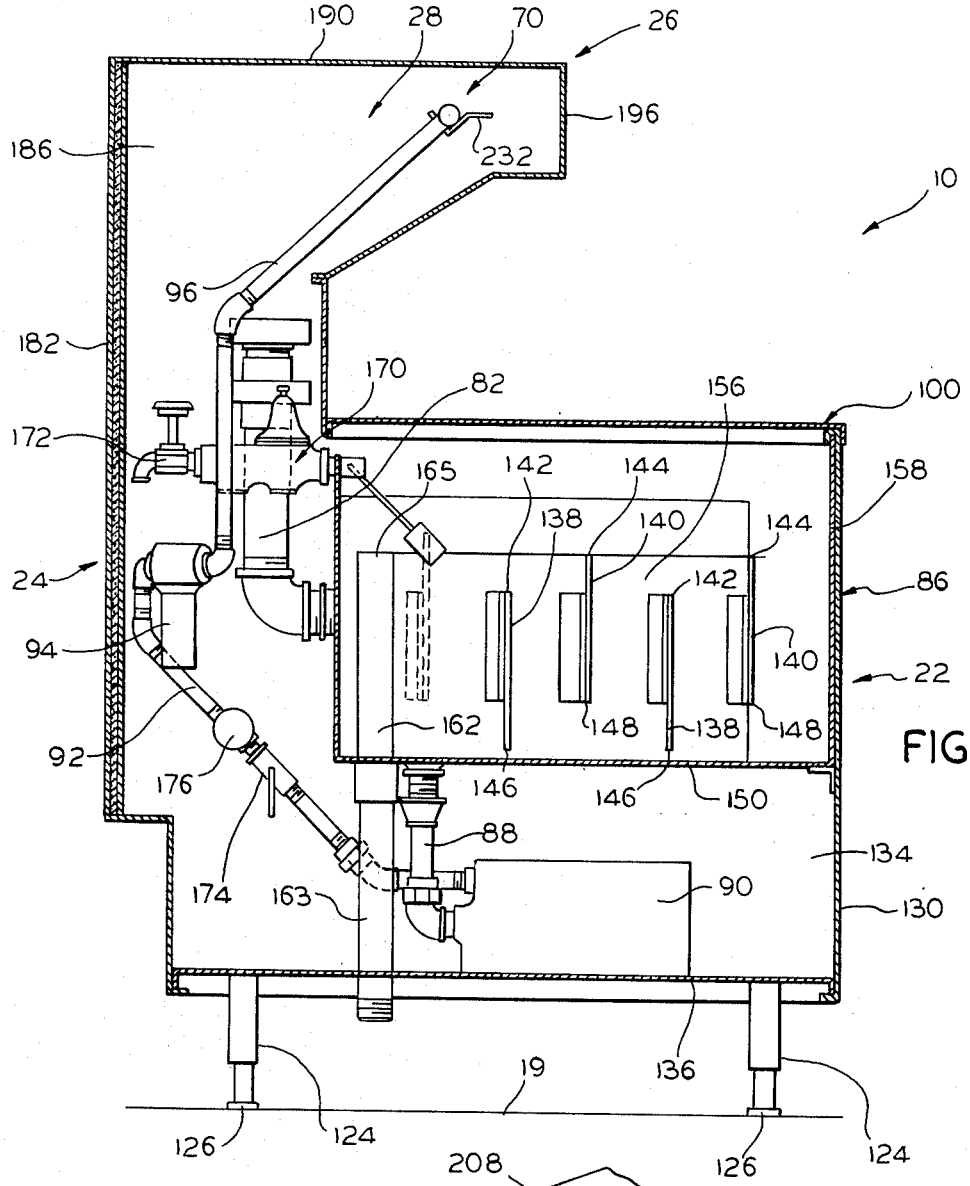
FIG. 6 is a diagrammatic sectional view taken substantially along 6—6 of FIGS. 1 and 7, more specifically illustrating the conduiting arrangement for the water spray system and grease separator associated therewith that forms a part of the hood and duct structure of the illustrated embodiment.
Figure 8:
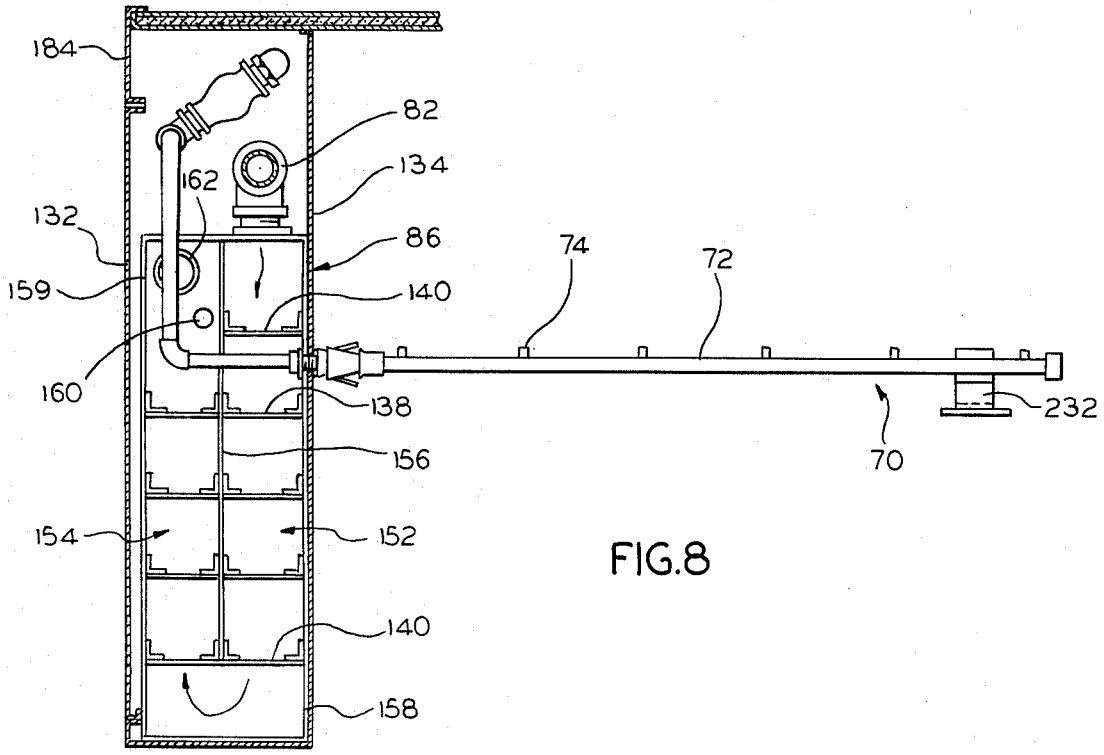
FIG. 8 is a plan view of the water spray conduiting system and grease separator that are shown in FIG. 6, with parts of the hood and duct structure being shown in horizontal section.

The side wall structure 22 in the form shown comprises a front panel 130, side panels 132 and 134, and bottom panel 136 suitably secured together and integrated with the cross wall structure 124 (as suggested in FIGS. 1, 6 and 8). Suitably affixed to the bottom panel 136 are a second set of the legs 124 having adjustable feet 126 (for the same purpose as the corresponding legs of side wall structure 20).

The separator tank 86 is suitably mounted within the side wall structure 22. The tank 86 itself is constructed in any suitable manner, and has mounted in same a plurality of vertically disposed spaced apart baffles 138 and 140, with the baffles 138 having their upper edges 142 lower than the upper edges 144 of the baffles 140, and with the lower edges 146 of the baffles 138 lower than the lower edges 148 of the baffles 140 (see FIG. 6). The lower edges 146 of the baffles 138 are disposed closely adjacent the bottom 150 of the tank 86, while the lower edges 148 of the baffles 140 are disposed well above the bottom 150 of the tank. The water level in tank 86 should be approximately at the level of the baffle edges 144.

As indicated in FIG. 8, the baffles 138 and 140 are in two rows 152 and 154 extending longitudinally of the tank 86, which rows are separated by a separator plate 156 that extends the full depth of the desired depth of water level in the tank except at the front end 158 of the tank where the water flow makes a U turn in moving from the separator plate row 152 to the separator plate rows 154.

The water flow coming from the sump and carrying the solidified grease enters the tank 86 at the inflow end of the baffle plate row 152 and flows to the right of FIG. 6 in a vertical manner over and under the respective baffles 138 and 140, down the baffle row 152, and at the turnaround end 158 of the tank 86, the water flow moves toward the rear 159 of the tank along the baffle row 154 in the same manner. The water leaves the tank 86 at drain pipe port 160 for entry into the drain pipe 88 that leads to the pump 90. Stand pipe 162 connected to drain pipe 163 has its upper end 165 set to control the maximum level weight of the water in tank 86. Drain pipe 163 may discharge overflow into stand pipe 162 into a collection basin removably applied under wall structure 22 or be connected by suitable piping to the sewer or other point of discharge.

As the water moves through the tank 86 in the manner indicated, the grease contained therein collects at the top of the water in the tank. The grease can then be readily ladled or otherwise removed off the top of the water in the tank 86 by the operator removing removable cover 100 on the side wall structure 22.

The pump 90 may be of any suitable type and is suitably mounted on the bottom wall 136 of the side wall structure 22. The pump 90 that is illustrated is intended to represent any suitable commercially available pump unit includng a suitable electrically operated drive motor for driving the pump. The pumping rate required will depend on the water flow rate desired through the system, which will depend to some extent on the size of the spray chamber 28 and air flow requirements though required for environmental reasons any particular installation.

In the form shown, the tank 86 is provided with a suitable float valve 170 to maintain the level of the water in the tank at a predetermined level, by adding water thereto as controlled by valve 170, with a source of water under pressure being connected thereto through suitable globe valve 172.

Conduit 92 is provided with a suitable off-on ball valve 174 and pressure gauge 176 as desired.

It is preferred that the panel 132 of the side wall structure 22 be made removable for ready access to the pump and other equipment within the side wall structure 22.

The cross wall structure 24 comprises a front panel 180, a rear panel 182, and side panels 184 and 186, suitably framed and integrated with the side wall structures 20 and 22 as well as header structure 26. The front and rear panels 180 and 182 are lined with suitable heat insulating sheeting 184 between which is disposed conduit 186 (see FIG. 4) that forms the make-up air duct 50.

On the separator tank side of the hood and duct structure 10, the side wall paneling 134 extends rearwardly and upwardly into the header 26 to form one end of the spray chamber 28 and also to receive a front panel section 188 that masks the drain pipe and other piping indicated in FIG. 6. The panel 122 of side wall structure 20 similary extends rearwardly and upwardly to form the other end of the spray chamber 28.

The header structure comprises top panel 190, side panels 192 and 194, front panel 196, suitably integrated together and with the cross wall side panels 184 and 186, and rear panel 182, as well as suitable framing that may be required to suitably rigidify the structure involved and define the forwardly projecting spray chamber 28 which in the form shown is disposed forwardly of the front panel 180 (see FIG. 4). Trough 80 is suitably mounted at the base of the spray chamber in association with the front panel 180 and cross frame member 200, as is suggested by the showing of FIG. 4.

The panels 134 and 186, the header 26, and the trough 80 define air intake window opening 201 which is subdivided by the baffle or grille structure 30.

Figure 5:
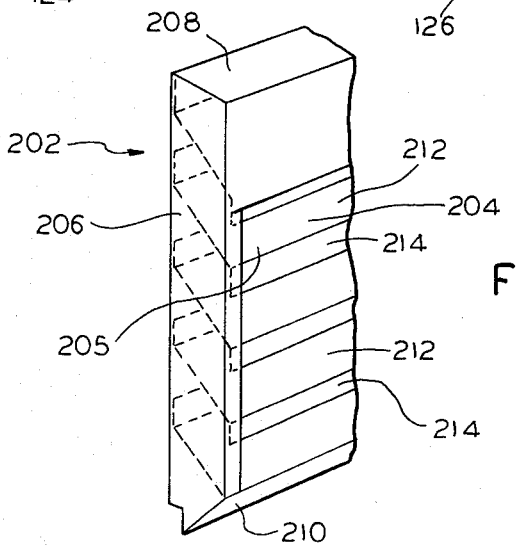
FIG. 5 is a fragmental perspective view showing one end of the air intake grille of the hood and duct structure.

In the specific embodiment illustrated, the window 201 has mounted in same a pair of grille or baffle assemblies 202 (see FIG. 7) each comprising a plurality of vanes 204 having their ends 205 integrated with side frame members 206 which are integrated with end frame members 208 and 210. The lowest vane 204 is of modified shaping to integrate with the end frame member 210 and still define the lower venturi way 62. The vanes 204 in general each define a web 212 and edge flanges 214 that are angled with respect to their respective webs 212 but in parallelism for application to the side frame members 206 in the manner indicated in FIGS. 4 and 5. In the form shown, the grille or baffle assemblies 202 are arranged so that the vane webs 212 are horizontally disposed with their edge flanges 214 coplanar with the plane of the respective assemblies 202. This orientation of the vanes 204 precludes egress of any water from the spray chamber outwardly of the window opening 201 into the cooking area.

The general arrangement of the illustrated embodiment is such that the vane edge flanges 214 on the intake side of the grille are of shorter dimension than the corresponding dimensions of the vane edge flange 214 on the discharge side of the grille, whereby the individual intake openings 64 are of greater area than the corresponding areas of discharge openings 66, to provide the aforementioned venturi effect.

The grille or baffle assemblies 202 are suitably secured side by side within the window opening 200. Each baffle or grille assembly may also provided with a spatula support 220 that may be used in the manner indicated in broken lines in FIG. 4 for long and short spatulas. Supports 220 each comprise a U-shaped member 221 having its ends suitably affixed to the side frame members 206 of the assembly 202 it forms a part of.

It will thus be seen that the venturi ways 62 are elongate in nature, in the plane of the grille or baffle structure 30 (and sidewise of window opening 201), and in one commercial embodiment of the invention, the ways 62 of each grille or air baffle 202 are 18 to 19 inches in length, with the venturi way inlet 64 having a dimension of one and one-half to two inches in the plane of the grille structure, defining the height of the way intake openings, while the discharge opening 66 of the respective ways 62 have a corresponding opening dimension of $\frac{5}{8}$ths to $\frac{3}{4}$ths of an inch.

As has already been indicated, it is preferable that the ways be defined by structure that will provide a venturi effect having a ratio of approximately 3 to 4 to 1 to achieve the desired cooling of the air that will induce the desired liquification and solidification of the grease contained in the air being drawn into the spray chamber. While one specific arrangement of defining the ways 62 is illustrated, it will be apparent that the desired shaping can be obtained in any suitable manner.

It is preferable that the hood and duct structure be formed so that the lower venturi way 62 be disposed about ten to twelve inches above the griddle working surface 29.

The forwardly extending portion 230 of the header may be employed to mount control equipment and the like, including the off-on switching for the blower 38 and pump 90. Spray assembly 70 is supported by the header from one or more suitable brackets 232.

As indicated in FIG. 2, the rear of the hood and duct structure is indented as at 240 for interfitting relation with a fixed stop 242 suitably made fast to the building in which the structure 10 is mounted.

In the form shown, the side wall structures 20 and 22 are each provided with a support member 250 that may serve as a grease can support as well as a centering means for the griddle unit 14. Horizontal cross member 250 affixed to front wall 180 has a resilient flap serving as a bumper stop for positioning the griddle under grilleing 30.

It will therefore be seen that the invention provides a hood and duct structure for griddle type cooking that is specifically adapted for effecting continuous wet scrubbing of the air ambient to the griddle so long as the griddle unit is in use, and providing a self contained water circulation system adapted for separation of the grease from the water and recirculation of the water through the system.

The invention avoids discharge of grease polluted air to the atmosphere as well as grease polluted water to the sewer system. Furthermore, in the event that the grease on the griddle should become ignited, the air flow through the grille structure 30 will confine the flames to the griddle surfacing involved until measures can be taken to douse the flames. As the air moving across the griddle surface moves directly into a water spray chamber, any flames entering the spray chamber will be immediately doused and have little effect on the internal arrangement of the hood and duct structure.

The foregoing description and the drawings are given merely to explain and illustrate the invention and the invention is not to be limited thereto, except insofar as the appended claims are so limited, since those skilled in the art who have the disclosure before them will be able to make modifications and variations therein without departing from the scope of the invention.

I claim:

1. An environmental hood and duct structure for griddles and the like, comprising:

a hood defining a spraying chamber having front portion including an air intake forwardly directed opening, grilleing mounted in said opening and formed to define a plurality of grille openings each shaped to define a venturi fluid flow way between the air intake and discharge sides of the grilleing and having a venturi ratio in the range of from about three to one to about four to one, said grilleing being forwardly and upwardly inclined at angle in the range of from about thirty degrees to about sixty degrees with respect to the horizontal, said grille openings comprising air intake ports to said spraying chamber, an upwardly open trough open to said chamber and positioned adjacent the lower end of said grilleing, nozzle means positioned adjacent the upper end of said grilleing for directing a water spray across said grilleing toward said trough, blower means for drawing air through said grille openings and said hood at a rate at least on the order of 1,000 cubic feet per minute, and means for conducting from the trough water collecting therein, whereby, grease ladened air drawn through the grilleing openings is wet scrubbed of the grease, and the water carrying the grease collecting in the trough is conducted therefrom.

2. The hood and duct structure set forth in claim 1 wherein:

the water sprayed by said nozzle means is at a temperature lying in the range of from approximately 15° F. to approximately 20° F. below the temperature of the air ambient to said structure.

3. The hood and duct structure set forth in claim 1 wherein:

said conducting means includes a water settling tank including means for separating the grease from the water, and including means for recycling the water through said nozzle means.

4. The hood and duct structure set forth in claim 3 wherein:

the recycled water includes a chemical wet scrubbing agent for overcoming emulsifying tendencies of the grease.

5. The hood and duct structure set forth in claim 1 wherein:

said grille openings are of rectangular configuration with the long dimension of same horizontally disposed, with the long dimension of said grille openings being on the order of eighteen-nineteen inches, and the short dimension of said grille openings being no more than about 2 inches.

6. The hood and duct structue set forth in claim 1 including:

a duct for supplying make up air to said grilleing and including a make up air outlet disposed adjacent the air intake side of the grilleing, and means for supplying make up air to said duct.

7. The hood and duct structure set forth in claim 6 wherein:

said duct is located rearwardly of said trough, with said duct outlet being located below said grilleing.

8. The hood and duct structure set forth in claim 7 including:

forwardly projecting, vertically disposed paneling sections disposed on either side of said grilleing, whereby the griddle or the like may be received between said paneling sections below the level of said grilleing.

9. The hood and duct structure set forth in claim 8 including in combination therewith a griddle received between said panel sections, with the gridle defining a griddle cooking surface disposed at a level that is on the order of 10 to 12 inches below the lower end of the grilleing.

10. An environmental hood and duct structure for griddles and the like, comprising:

a hood defining a spraying chamber having front portion including an air intake forwardly directed opening, grilleing mounted in said opening and formed to define a plurality of grille openings each shaped to define a venturi fluid flow way between the air intake and discharge sides of the grilleing and having a venturi ratio in the range of from about three to one to about four to one, said grilleing being forwardly and upwardly inclined at an angle in the range of from about 30° to about 60° with respect to the horizontal, said grille openings comprising air intake ports with said spraying chamber, an upwardly open trough open to said chamber and positioned adjacent the lower end of said grilleing, nozzle means positioned adjacent the upper end of said grilleing for directing a water spray across said grilleing toward said trough, means for connecting said spraying chamber to air movement impelling means for inducing rapid air flow of air ambient to said grilleing through same and said spraying chamber, and means for conducting from the trough water and grease collecting therein.

* * * * *